US008359684B2

(12) United States Patent
Yoon

(10) Patent No.: US 8,359,684 B2
(45) Date of Patent: Jan. 29, 2013

(54) SPRING MATTRESS HAVING A HEATING FUNCTION

(76) Inventor: Jang Hoo Yoon, Seoul (KR)

( * ) Notice: Subject to any disclaimer, the term of this patent is extended or adjusted under 35 U.S.C. 154(b) by 0 days.

(21) Appl. No.: 13/578,533

(22) PCT Filed: Feb. 11, 2011

(86) PCT No.: PCT/KR2011/000919

§ 371 (c)(1),
(2), (4) Date: Aug. 10, 2012

(87) PCT Pub. No.: WO2011/102620

PCT Pub. Date: Aug. 25, 2011

(65) Prior Publication Data

US 2012/0311784 A1 Dec. 13, 2012

(30) Foreign Application Priority Data

Feb. 18, 2010 (KR) ..... 10-2010-0014668
Aug. 10, 2010 (KR) ..... 10-2010-0076753

(51) Int. Cl.
*A47C 21/04* (2006.01)

(52) U.S. Cl. ..... 5/423; 5/726

(58) Field of Classification Search ..... 5/421, 423, 5/284, 652.1, 652.2, 724–726
See application file for complete search history.

(56) References Cited

U.S. PATENT DOCUMENTS

| | | | | |
|---|---|---|---|---|
| 2,400,790 | A * | 5/1946 | Tolen | 5/284 |
| 2,425,655 | A * | 8/1947 | Tompkins | 601/57 |
| 2,461,432 | A * | 2/1949 | Mitchell | 5/284 |
| 2,493,067 | A * | 1/1950 | Goldsmith | 5/726 |
| 3,266,064 | A * | 8/1966 | Figman | 5/726 |
| 4,888,958 | A * | 12/1989 | Ella | 62/237 |
| 6,052,853 | A * | 4/2000 | Schmid | 5/726 |
| 6,336,237 | B1 * | 1/2002 | Schmid | 5/726 |
| 6,370,718 | B1 * | 4/2002 | Schmid | 5/726 |
| 6,546,576 | B1 * | 4/2003 | Lin | 5/423 |
| 6,904,629 | B2 * | 6/2005 | Wu | 5/423 |
| 7,165,281 | B2 * | 1/2007 | Larssson et al. | 5/724 |
| 2003/0019044 | A1 * | 1/2003 | Larsson et al. | 5/724 |
| 2003/0084510 | A1 * | 5/2003 | Lin | 5/423 |
| 2004/0064888 | A1 * | 4/2004 | Wu | 5/423 |

FOREIGN PATENT DOCUMENTS

| | | | |
|---|---|---|---|
| JP | 04-108411 | A | 4/1992 |
| KR | 20-1995-0016505 | U | 7/1995 |
| KR | 20-2010-0006713 | U | 7/2010 |

* cited by examiner

*Primary Examiner* — Robert G Santos
(74) *Attorney, Agent, or Firm* — Allen Zhi Yang Xue; Anova Law Group, PLLC

(57) ABSTRACT

The present invention is directed to a mattress which includes a heating unit in an enclosed space thereof to quickly heat the enclosed interior space of the mattress to a certain temperature and replacement main parts that are assembled in a separable box form to facilitate the maintenance service.

1 Claim, 7 Drawing Sheets

[Fig. 1]
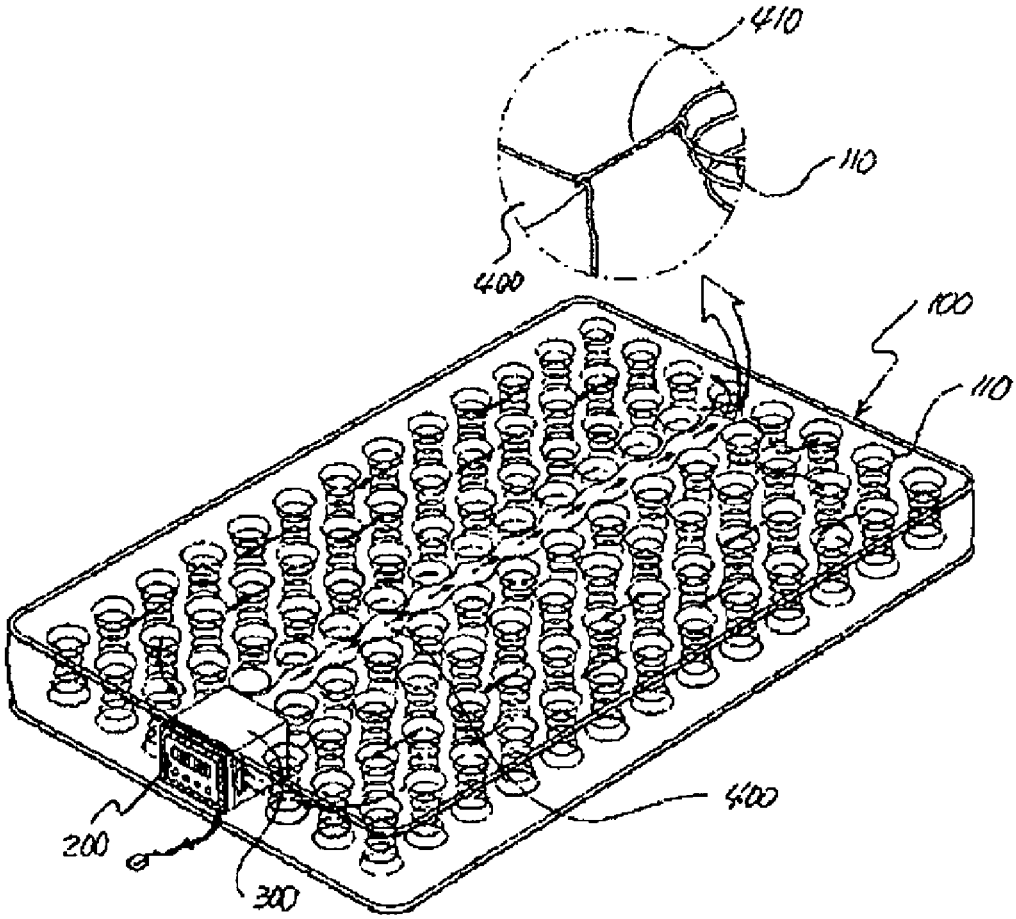

[Fig. 2]
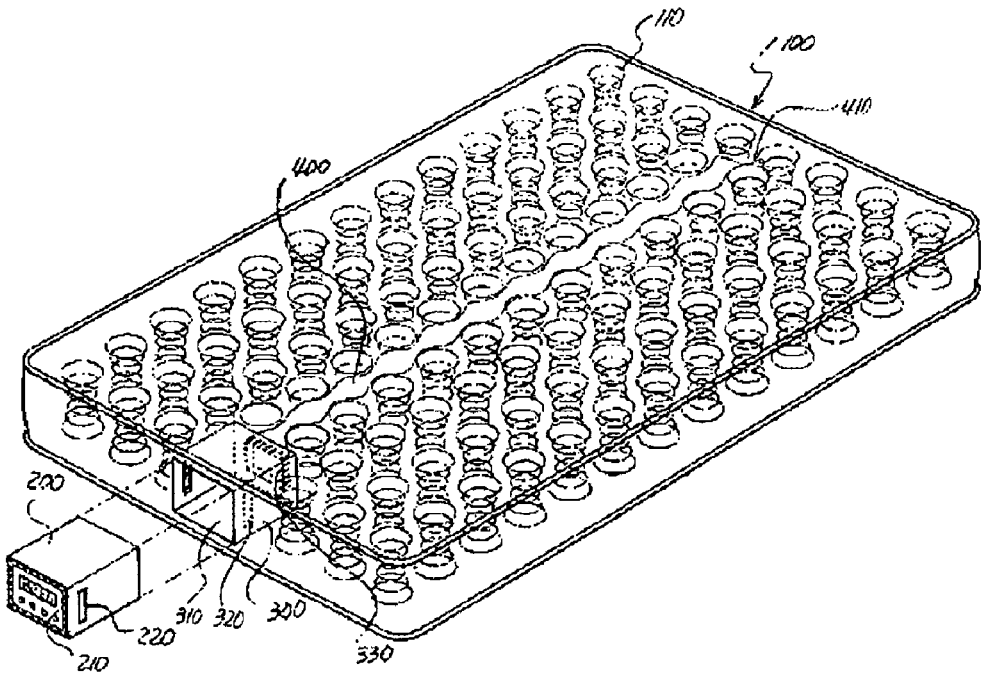

[Fig. 3]
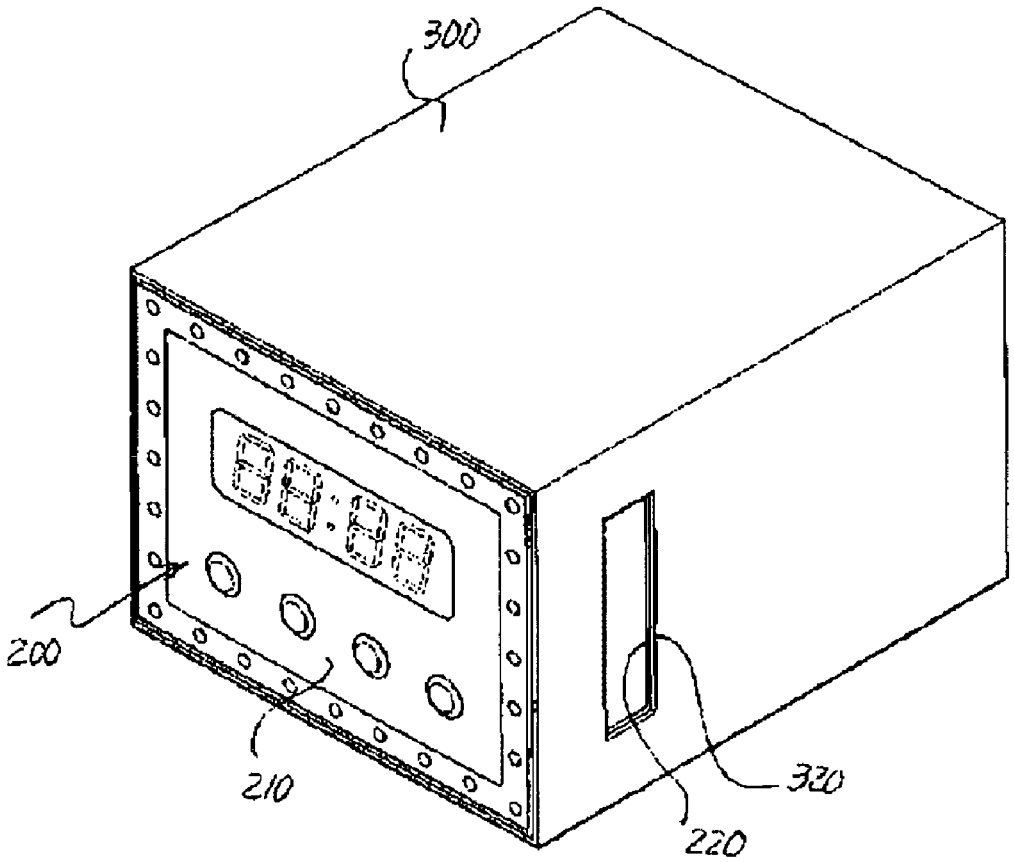

[Fig. 4]
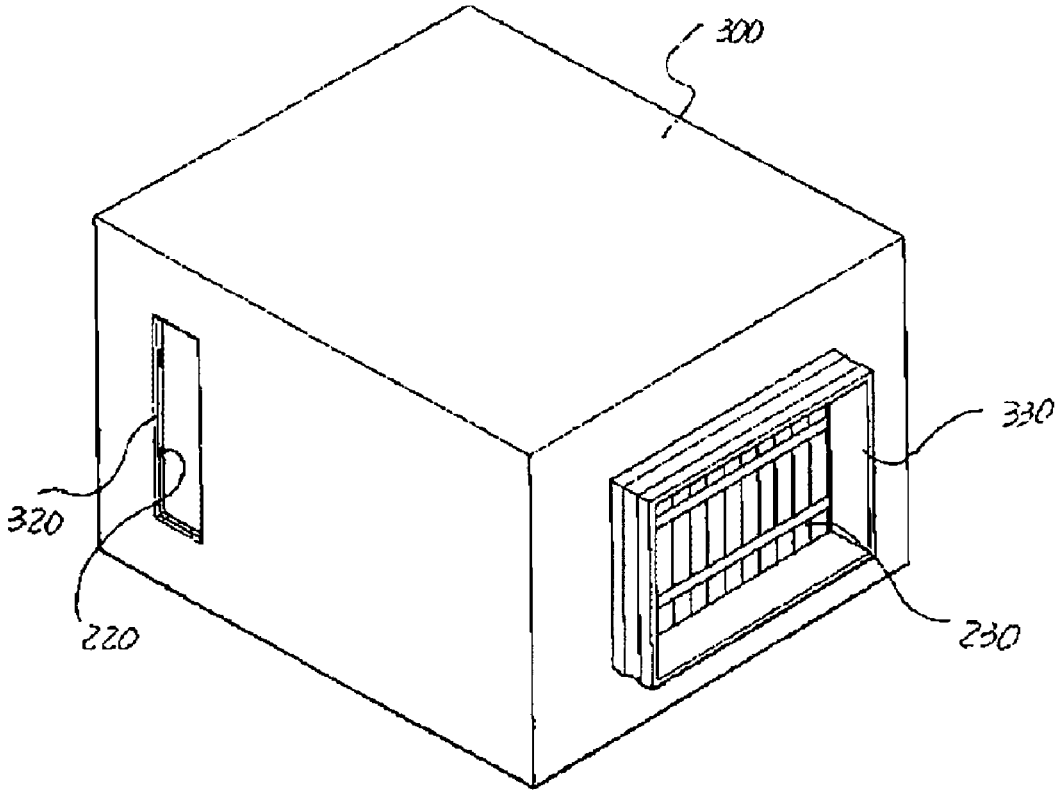

[Fig. 5]
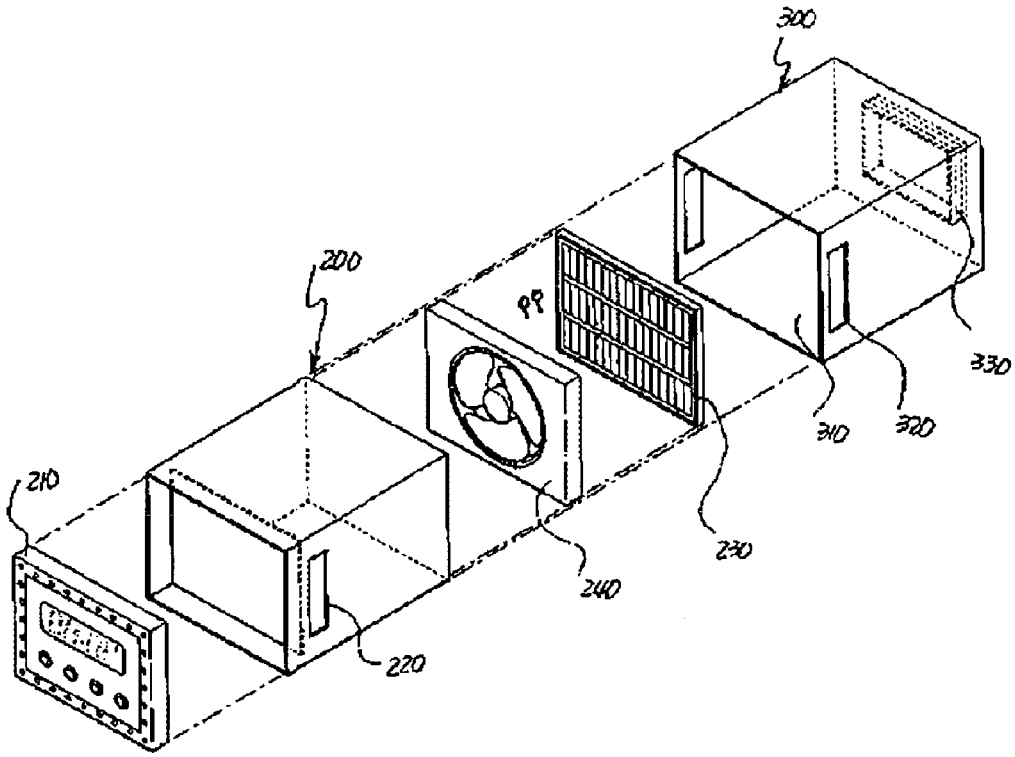

[Fig. 6]
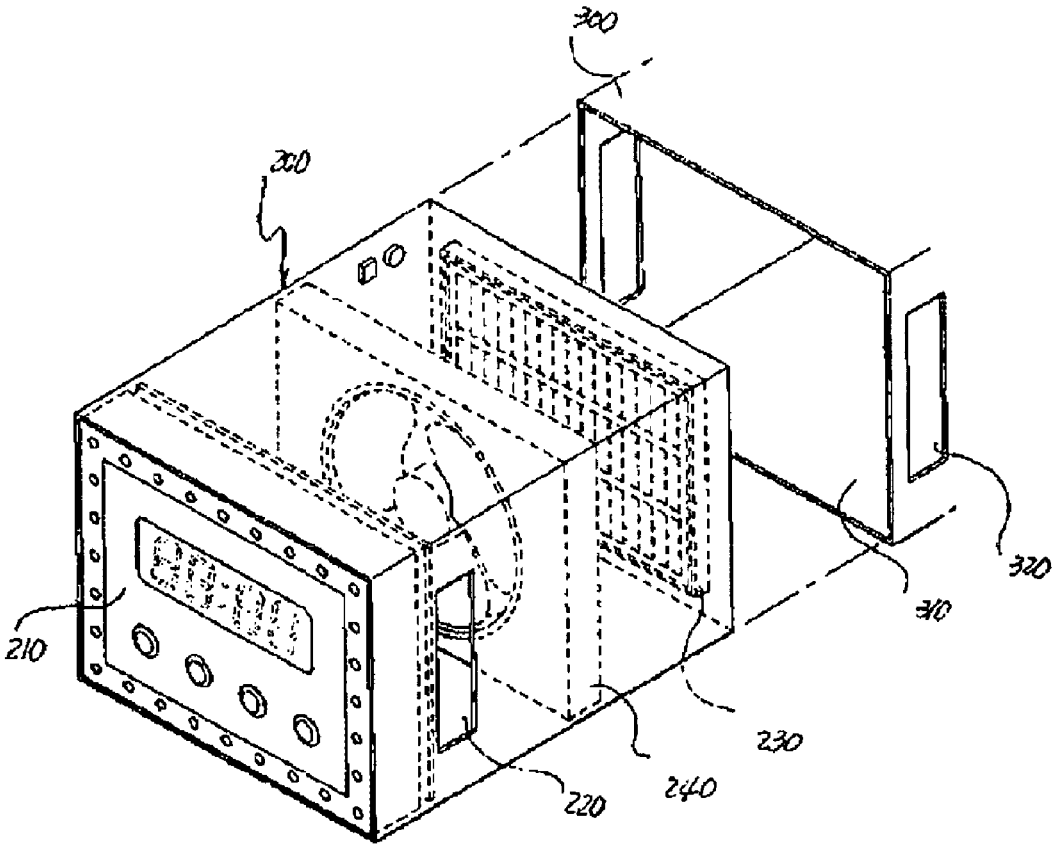

[Fig. 7]
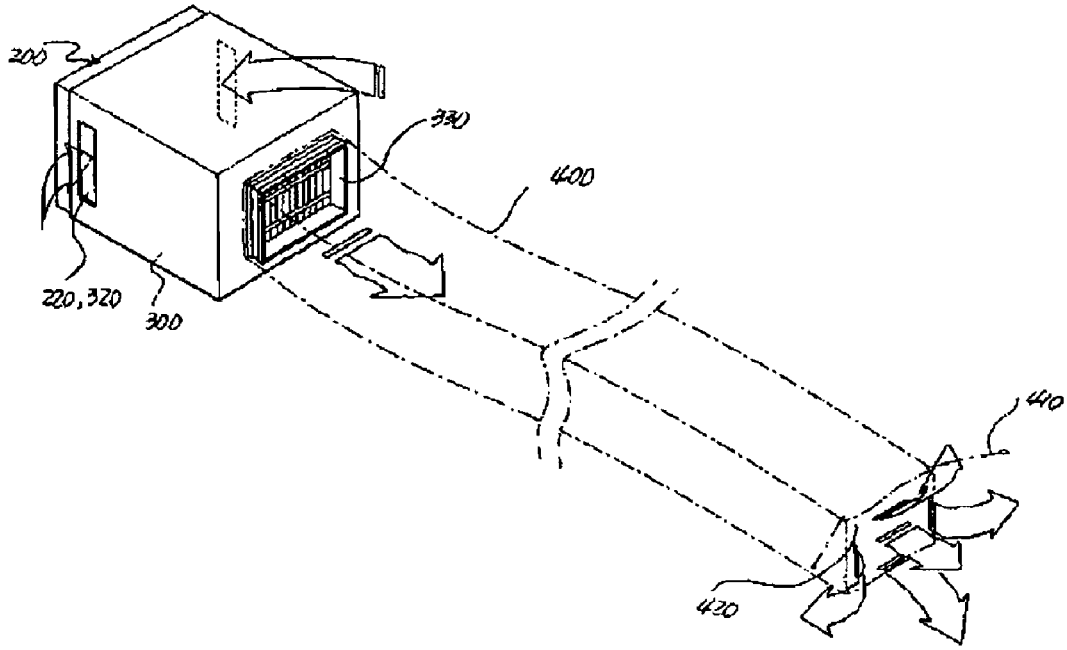

SPRING MATTRESS HAVING A HEATING FUNCTION

BACKGROUND OF THE INVENTION

1. Field of the Invention

The present invention relates to mattresses, and more particularly, to a spring mattress that is configured is such a way that a heating apparatus, integrated with a variety of parts, is detachably installed in the inner space, rapidly heats the air inside the space at a certain temperature via the heating apparatus, and allows a repairman to easily separate it from the spring mattress and to fix the failure of the heating apparatus.

2. Description of the Related Art

In general, home heating mats are divided in to electricity mats and health care heating mats. They are configured in such a way that gem stones, ceramic pieces, etc. are attached onto their upper surface and an electric heating wire is placed thereunder, so that the electric heating wire heats the gem stones and ceramic pieces. They are also shaped as a rectangle and have a certain thickness so that the user can easily lie down.

Although the conventional heating mats, configured as described above, can generate heat via the electric heating wire and provide the user with warmth, the electric heating wire can emit a lot of electromagnetic waves to the user, which may cause a serious problem.

DISCLOSURE

Technical Problem

The present invention solves the above problems, and provides a spring mattress that is configured in such a way that a heating apparatus, integrated with a variety of parts, is detachably installed in the inner space, so that the heating apparatus can easily heat the air inside the space at a certain temperature and a repairman can easily separate the heating apparatus from the spring mattress thereby fixing its failure.

Technical Solution

In accordance with an exemplary embodiment of the present invention, there is provided a spring mattress that forms an inner space, isolated from the outside environment, in which a number of inner springs are installed, being spaced apart from each other with a certain interval. The spring mattress comprises a casing, a module box, and an air guider.

The casing is configured in such a way that: its inner portion forms a receiving part; its back side forms a coupling part protruded outwards; and its right and left sides form first air inlets respectively. The casing is fixed to the inner front side of the spring mattress. The receiving part is open with respect to the outside. The module box is detachably installed into the receiving part of the casing. The module box has a Positive Temperature Coefficient (PTC) heater, a ventilating fan, and a controller in the inner portion. The module box allows primary parts in the inner portion to be separated from the casing when the module box is separated form the receiving part, thereby providing convenient repair. The air guider is configured in such a way that one end is coupled to the coupling part of the casing, another end of which is coupled to springs via hooks, opposite the front side of the mattress, and its heat air outlet is located at the opposite end of the front side of the mattress inside the inner space. The air guider is made of a flexible material to prevent the interference with the springs and to stand a user's weight. The module box has second air inlets at its both sides corresponding to the first air inlets when it is inserted into the casing and allows heated air to be circulated in the module box and the mattress.

Advantageous Effect

As described above, the spring mattress, according to the present invention, includes the heating apparatus installed in the inner space. The heating apparatus can heat air in the inner space via the PTC heater, and rapidly transfer the heated air to the rear side of the mattress 100 via the air guider. The heated air can transfer its heat energy to the spring mattress. After that, the heated air is returned to the first and second air inlets. While these processes are repeated, the spring mattress can be evenly heated.

In addition, since the PTC heater, ventilating fan, and controller are installed to the module box together, the module box can be easily installed and separated to and from the spring mattress. Therefore, if an error occurs in the module box, the user can easily separate it from the spring mattress and carry it to the repair center.

BRIEF DESCRIPTION OF THE DRAWINGS

FIG. 1 is a perspective view illustrating a spring mattress having a heating function according to an embodiment of the present invention;

FIG. 2 is an exploded perspective view illustrating the spring mattress of FIG. 1;

FIG. 3 is a front perspective view illustrating a heating apparatus according to an embodiment of the present invention;

FIG. 4 is a rear perspective view illustrating the heating apparatus;

FIG. 5 is an exploded perspective view illustrating the heating apparatus;

FIG. 6 is a perspective view illustrating a state where the body of the heating apparatus is separated from the casing; and FIG. 7 is a rear perspective view illustrating a state where an air guider is connected to the heating apparatus according to an embodiment of the present invention.

DETAILED DESCRIPTION OF EXEMPLARY EMBODIMENTS

Hereinafter, exemplary embodiments of the present invention are described in detail with reference to the accompanying drawings.

The mattress 100 according to the present invention forms an inner space, isolated from the outside environment, and has a number of inner springs 110 spaced apart from each other with a certain interval. The mattress 100 also has a heating apparatus.

As shown in FIGS. 1 to 7, the heating apparatus includes a casing 300, a module box 200, and an air guider 400.

The casing 300 is configured in such a way that its inner side forms a receiving part 310, its back side forms a coupling part 330 protruded outwards, and its right and left sides form first air inlets 320 respectively. The casing 300 is fixed to the inner front side of the spring mattress 100. The receiving part 310 is open with respect to the outside.

The module box 200 is detachably installed into the receiving part 310 of the casing 300. The module box 200 has a Positive Temperature Coefficient (PTC) heater 230, a ventilating fan 240, and a controller 210 in the inner portion. The module box 200 allows primary parts in the inner portion to be separated from the casing 300 when the module box 200 is separated form the receiving part 310, thereby providing convenient repair.

The air guider 400 is configured in such a way that one end is coupled to the coupling part 330 of the casing 300, another end of which is coupled to springs via hooks 410, opposite the front side of the mattress 100, and its heat air outlet 420 is located at the opposite end of the front side of the mattress 100 inside the inner space. The air guider 400 is made of a flexible material to prevent it from interfering with the springs 110 and to withhold a user's weight.

The module box 200 has second air inlets 220 at both sides corresponding to the first air inlets 320 when it is inserted into the casing 300 and allows heated air to be circulated in the module box 200 and the mattress 100.

The module box 200 also includes electronic parts for performing a variety of functions. The electronic parts, PTC heater 230, ventilating fan 240, and controller 210, installed to the module box 200, operate to apply heat to the mattress 100.

The PTC heater 230 is installed near to the coupling part 330 located at the rear side of module box 200 and heats air from the ventilating fan 240 to a certain temperature. The ventilating fan 240, installed between the PTC heater 230 and the first and second air inlets 320 and 220, circulates air in the inner space of the mattress 100.

The controller 210, installed to the front side of the module box 200, includes a display, an on/off switch, a temperature adjustment, a timer, etc. Although the embodiment of the present invention is implemented in such a way that the controller 210 includes a display, an on/off switch, a temperature adjustment, and a timer, it should be understood that the present invention is not limited to the embodiment. That is, the controller 120 may further include parts for performing a variety of functions according to a user's selection or a manufacturer's design.

The air guider 400 is shaped as a pipe of a certain distance. One end of the air guider 400 is coupled to the coupling part 330 of the casing 300. Another end is coupled to up, down, right and left points of springs via hooks 410, opposite the front side of the mattress 100. The heat air outlet 420 of the air guider 400 is located at the opposite end of the front side of the mattress 100 inside the inner space. The air guider 400 can rapidly transfer the heated air to the rear side (user's legs) of the mattress 100 without reducing the relatively high temperature of the heated air, so that the heated air can evenly heat the inner space of the mattress 100 and then returns to the first and second air inlets 320 and 220.

It is preferable that the air guider 400 is made of a flexible material that will not be deformed by heat, for example, urethane film, synthetic leather, cloth, etc. On the other hand, the air guider 400 may be made of a rigid material, such as metal or synthetic resin. In that case, the air guider may be interfered with the springs during the installation and may also restrict the elasticity of the springs when the user lies upon it.

In installation, the user prepares: the casing 300 including the first air inlets 320, receiving part 310, and the coupling part 330; the module box 200 equipped with primary parts, such as the PTC heater 230, ventilating fan 240, controller 210, etc.; and the air guider 400 including the heat air outlet 420 and hooks 410.

One end of the air guider 400 is coupled to the coupling part 330 and the casing 300 is fixed to the inner front side of the mattress 100. The receiving part 310 of the casing 300 is open to the outside of the mattress 100. Another end of the air guider 400 is coupled to the up, down, right and left points of the springs using the hooks 410.

After that, the module box 200 is inserted into the receiving part 310 of the casing 300, to match the first air inlets 320 with the second air inlets 220. Next, the module box 200 is detachably fixed to the casing 300. Finally, when an electric power line is connected to the module box 200, the heat apparatus can perform a heating function.

In operation, when the user can first set temperature, an operation time, etc. via the controller 210 and then turn on the heating apparatus, the ventilating fan 240 circulates the air in the inner space of the mattress 100, receiving the air via the first and second air inlets 320 and 220 to allow the received air to be heated by the PTC heater 230. The heated air is transferred via the air guider 400 and then discharged to the inner space of the mattress 100 via the heat air outlet 420. Therefore, the heated air can evenly heat the inner space. After the heated air transfers its heat energy to the mattress 100, it flows into the first and second air inlets 320 and 220. While the heat apparatus is operating, the heated air is repeatedly circulated as described above.

Meanwhile, the mattress 100 may have a failure during the use. Most failures occur in electric parts and the primary parts. Since the electric parts and primary parts are installed to the module box 200, the user can easily separate the module box 200 from the casing 300. Therefore, the user can carry it to the repair center and easily and rapidly fix it.

What is claimed is:

1. A spring mattress (100) that forms an inner space, isolated from the outside environment, in which a number of inner springs (110) are installed, being spaced apart from each other with a certain interval, the spring mattress comprising:

a casing (300) configured in such a way that an inner portion of the casing forms a receiving part (310), a back side of the casing forms a coupling part (330) protruded outwards, and right and left sides of the casing form first air inlets (320) respectively, wherein the casing (300) is fixed to an inner front side of the spring mattress (100) and the receiving part (310) is open with respect to the outside environment;

a module box (200) detachably installed into the receiving part (310) of the casing (300), wherein the module box (200) has a Positive Temperature Coefficient (PTC) heater (230), a ventilating fan (240), and a controller (210) therein and allows the heater, fan, and controller therein to be separated from the casing (300) when the module box (200) is separated from the receiving part (310), thereby providing convenient repair; and an air guider (400) configured in such a way that one end thereof is coupled to the coupling part (330) of the casing (300), another end of which is coupled to springs via hooks 410, opposite the inner front side of the mattress (100), and a heat air outlet thereof (420) is located at the opposite end of the inner front side of the mattress (100) inside the inner space, wherein the air guider (400) is made of a flexible material to prevent the interference with the springs (110) and withholds a user's weight, wherein the module box (200) has second air inlets (220) at two sides corresponding to the first air inlets (320) when it is inserted into the casing (300) and allows heated air to be circulated in the module box (200) and the mattress (100).

* * * * *